United States Patent [19]

Kiekhaefer

[11] 3,943,876

[45] Mar. 16, 1976

[54] WATER JET BOAT DRIVE

[75] Inventor: Elmer Carl Kiekhaefer, Winter Haven, Fla.

[73] Assignee: Kiekhaefer Aeromarine Motors, Inc., Fond du Lac, Wis.

[22] Filed: Dec. 6, 1973

[21] Appl. No.: 422,334

[52] U.S. Cl. ..... 115/12 R

[51] Int. Cl.[2] ..... B63H 11/00

[58] Field of Search ..... 115/11, 12 R, 12 A, 13, 115/14, 15, 16; 114/151; 60/221–222

[56] References Cited

UNITED STATES PATENTS

| | | | |
|---|---|---|---|
| 3,073,277 | 1/1963 | Lee | 115/12 R |
| 3,089,454 | 5/1963 | Chronic | 115/12 R |
| 3,121,994 | 2/1964 | Aldropp | 115/12 R |
| 3,187,708 | 6/1965 | Fox | 115/12 R |
| 3,266,733 | 8/1966 | Goehler | 115/16 |
| 3,336,752 | 8/1967 | Smith | 115/16 |
| 3,422,788 | 1/1969 | Horan | 115/12 R |
| 3,422,789 | 1/1969 | Wynne et al. | 115/12 R |
| 3,641,964 | 2/1972 | Lee | 115/12 R |
| 3,742,895 | 7/1973 | Horiuchi | 115/12 R |
| 3,782,320 | 1/1974 | Groves | 115/12 R |

FOREIGN PATENTS OR APPLICATIONS

| | | | |
|---|---|---|---|
| 1,381,494 | 10/1963 | France | 115/12 R |
| 1,335,579 | 7/1963 | France | 115/16 |

*Primary Examiner*—Trygve M. Blix
*Assistant Examiner*—Jesus D. Sotelo
*Attorney, Agent, or Firm*—Andrus, Sceales, Starke & Sawall

[57] ABSTRACT

A water-jet is mounted rigidly entirely outboard of the boat and driven from an inboard engine by an interconnecting chaft through the transom. The tail nozzle is mounted concentric of and spaced from the pump chamber of the jet and extends rearwardly therefrom axially thereof. A butterfly trim vane is pivotally mounted on a transverse horizontal axis in the tail nozzle and is adapted to close the nozzle for blocking the jet and compelling a reverse flow of the water from the pump through passages between the pump chamber and tail nozzle. A steering vane is mounted on a vertical axis rearwardly of the tail nozzle and carries a rudder disposed beneath the jet steering vane for steering during reversal of the jet. The engine exhaust is introduced to the jet stream within the tail nozzle and has a by-pass operable during reverse of the jet stream.

11 Claims, 3 Drawing Figures

Fig. 2
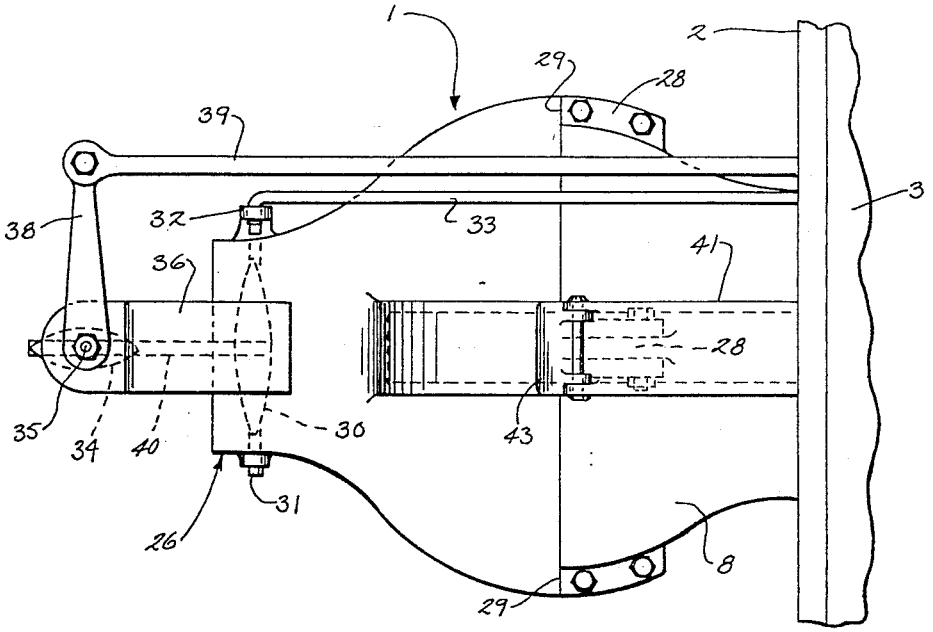
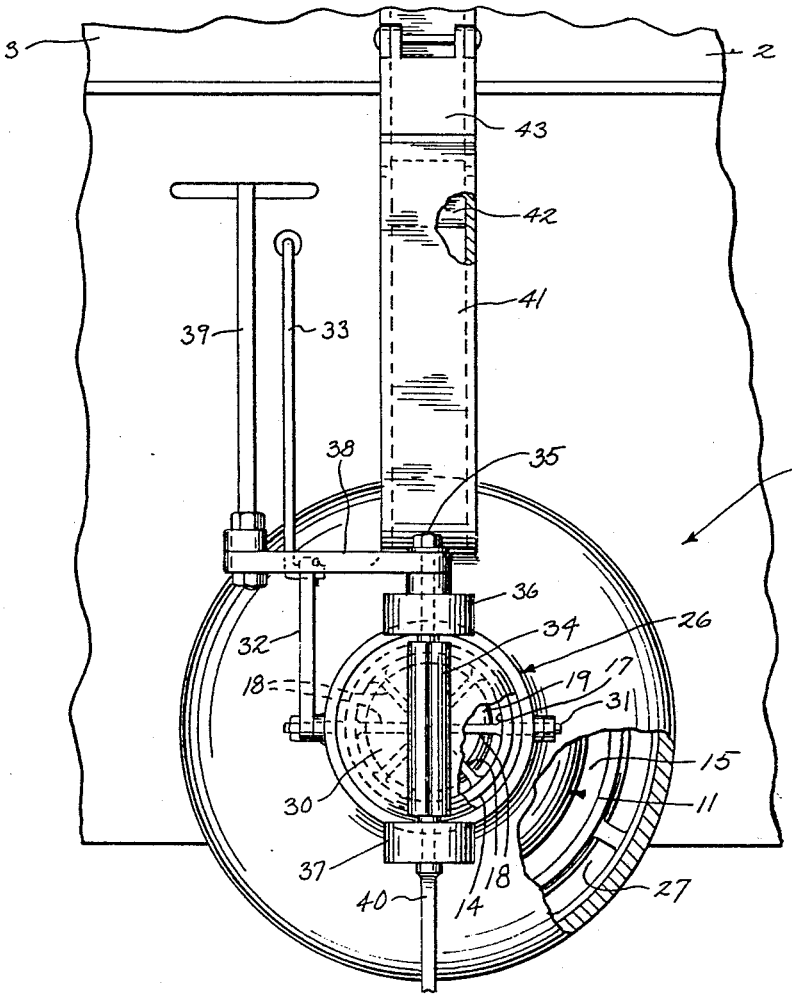
Fig. 3

WATER JET BOAT DRIVE

BACKGROUND OF THE INVENTION

This invention relates to a water-jet boat drive.

This art is still looking for a simple, durable generally maintenance free and low cost water-jet drive.

Boat manufacturers greatly prefer units that can be installed with little change in boat design. This means a preference for units secured solely to the transom of the boat and extending rearwardly therefrom without requiring any change in the construction of the bottom of the boat.

Most transom attached water-jet units present problems in trim adjustment and also in reverse drive. Some proposals forget trim adjustment completely and direct the jet stream selectively to either side in reverse, while other proposals would mount the unit dirigibly and shunt the jet downwardly in reversing thereby dangerously tending to lift the stern of the boat and drive the bow into the water.

None of the proposals applicant is aware of have any means for disposal of the engine exhaust through the jet.

SUMMARY OF THE INVENTION

According to the present invention the entire water-jet unit is rigidly attached to the rear of the boat transom and constitutes a generally tubular housing with an inlet disposed at a slight downward angle from the bottom of the boat rearwardly from the transom, the housing terminating in a jet nozzle disposed axially at a slight upward angle to the plane of the boat bottom to effect a more efficient planing of the boat.

A supplementary tail jet nozzle is tandemly disposed concentrically with respect to the pump housing with the skirt of the jet nozzle radially spaced from the pump housing to provide a reverse path for the jet stream that generally surrounds the pump housing during reversal of the drive.

A butterfly vane in the supplementary nozzle is disposed on a horizontal transverse axis and is controlled to adjust the trim of the boat during forward boat drive and to completely close the jet nozzle and reverse the jet stream outside the pump housing for reverse boat drive.

Steering of the boat is effected by a suitable vane or other means at the discharge mouth of the jet nozzle to divert the jet stream selectively to either side of the forward direction of boat movement.

A supplemental steering rudder extends downwardly from the generally vertical shaft of the steering vane to assist in forward steering of the boat and also to provide steering of the boat when reversing.

The engine exhaust is introduced through the skirt of the jet nozzle to the jet stream and enters the stream by induction and is discharged therewith into the water behind the boat. upon reversal of the jet stream the exhaust is diverted from the jet and allowed to escape into the air.

BRIEF DESCRIPTION OF THE DRAWINGS

The accompanying drawings illustrate the preferred mode of carrying out the invention as presently contemplated by the applicant.

In the drawings:

FIG. 2 is a top plan view of the construction of FIG. 1 with parts broken away and sectioned;

FIG. 3 is a rear end elevation of the construction of FIG. 1 with parts broken away and sectioned.

DESCRIPTION OF THE PREFERRED EMBODIMENT

Figure 1:
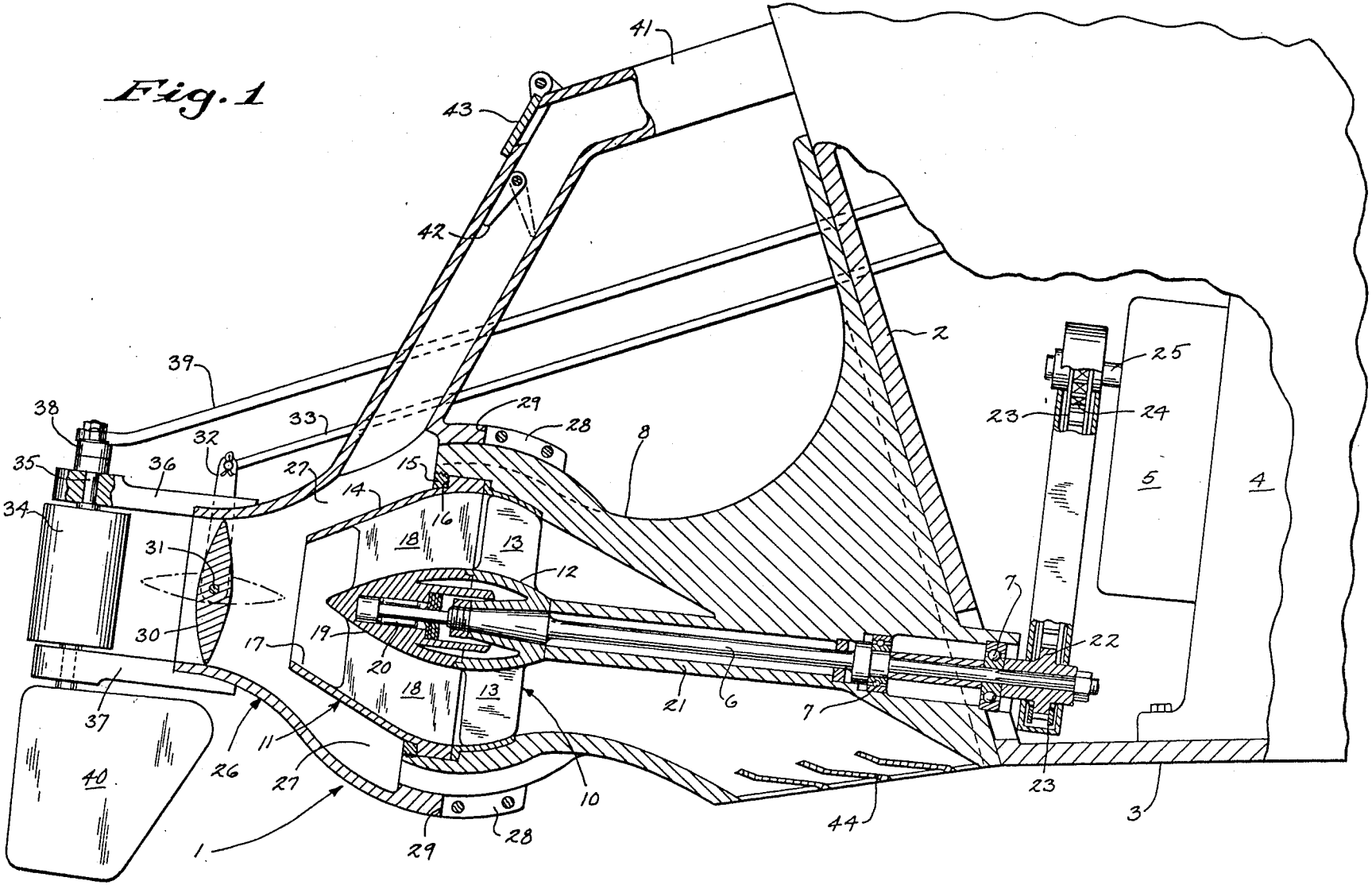
FIG. 1 is a vertical longitudinal axial section through the jet drive and the rear portion of the boat showing its connection to the inboard engine drive.

Referring to the drawing, the water-jet boat drive illustrated comprises a jet pump 1 secured to the rear side of the transom 2 of a boat 3 and driven from the inboard engine 4 by means of transmission 5 and drive shaft 6 extending through the boat transom and carried by suitable thrust bearings 7.

The jet pump 1 comprises a tubular housing 8 having its forward open inlet end facing downward just behind the boat and generally in the plane of the boat bottom except for a slight angle of approximately 7° downwardly and rearwardly thereof to effect a scooping of the water into the inlet or mouth of the housing as the boat moves forwardly in the water.

The rear end of tubular housing 8 is enlarged to receive the impeller 10 of pump 1 and is belled to receive the diffuser head 11 of the pump.

The impeller 10 is carried by drive shaft 6 and comprises a hub 12 with a series of blades 13 thereon adapted to give a longitudinal rearward thrust to the water causing it to flow rapidly through tubular housing 8 in response to rotation of the impeller.

The diffuser head 11 comprises a jet nozzle or tubular housing 14 secured in the belled rear end of housing 8 by a gland ring or nut 15 threaded into the latter and bearing against an outward shoulder 16 on housing 14.

The housing 14 extends rearwardly from shoulder 16 in a gradually reduced diameter of generally frustoconical shape to discharge the water rearwardly from the pump through a jet nozzle opening 17 axially of shaft 6.

The housing 14 contains a series of radial circumferentially spaced diffuser vanes 18 which are designed to remove the rotary component of movement of the water resulting from the rotation of blades 13, as the water passes to and through the jet nozzle 17.

The diffuser vanes 18 carry a central hub 19 which contains a bearing 20 for the rear end of shaft 6.

The hubs 12 and 19 are generally complemental in providing a torpedo shaped central hub within the pump for streamlined flow of the water thereover.

The shaft 6 extends forwardly of hub 12 through a stationary sleeve 21 and through bearings 7 to the inside of boat 3.

The forward end of shaft 6 carries a drive sprocket 22 which is driven by an endless cog belt 23 from a similar sprocket 24 on the output shaft 25 of transmission 5.

An auxiliary jet nozzle 26 is disposed in tandem to and axially aligned with jet nozzle 17.

The skirt of tail jet nozzle 26 is of generally larger diameter than jet nozzle 17 and housing 14 to provide a radial space 27 therebetween.

The belled end of housing 8 has a plurality of radially extending circumferentially spaced ribs 28 thereon adapted to fit inside the forward end of tail nozzle 26.

Each rib 28 has a rearwardly facing shoulder 29 thereon against which the tail nozzle 26 abuts and is secured by suitable bolts.

The tail nozzle 26 extends rearwardly from the mouth of jet nozzle 17 in alignment therewith to receive the water jet and discharge it into the surrounding body of water or air, as the case may be.

As circular trim vane 30 is disposed inside tail nozzle 26 and mounted on a horizontal pivot shaft 31 extending through the walls of the nozzle.

The vane 30 may be pivotally actuated or adjusted by any suitable means such as the lever 32 fixed to one end of the shaft 31 and actuating member 33 connected thereto and operable from within the boat 3.

Adjustment of vane 30 angularly away from a position parallel to the axis of the jet stream from jet nozzle 17, effects a corresponding change in direction of the jet stream either upwardly or downwardly to provide the desired trim of the boat.

The trim vane 30 also serves to provide for reversal of the boat, as when the vane is pivoted to a position completely closing the tail nozzle 26, thereby forcing the water being discharged through jet nozzle 17 to reverse its flow and to be discharged forwardly through the space 27 around the outside of housings 8 and 14.

Steering of the boat is provided by a steering vane 34 mounted on a vertical shaft 35 carried by upper and lower brackets 36 and 37, respectively, extending rearwardly from the discharge end of tail nozzle 26.

The steering vane 34 is normally disposed in the vertical plane of the drive shaft 6 and axis of the jet stream discharging through tail nozzle 26.

Angular displacement of steering vane 34 to either side of its normal position diverts the jet stream to one side or the other to effect steering of the boat.

For this purpose a lever or tiller arm 38 on the upper end of shaft 35 is actuated by any suitable means such as the actuating member 39 connected to arm 38 and extending into boat 3 for operation by suitable steering mechanism therein.

When the boat is reversed as previously described steering is effected by a rudder 40 secured to the lower end of vertical shaft 35 and extending downwardly into the surrounding water.

Rudder 40 is actuated by shaft 35 simultaneously with steering vane 34 and serves to cooperate therewith in steering the boat when moving forward as well as the steering means when the boat is moving in reverse.

Where engine 4 has a substantial exhaust, as in the case of an internal combustion engine, it is desirable to discharge the exhaust into the jet stream without interfering with the thrust of the jet.

For this purpose an engine exhaust conduit 41 extends through the transom 2 and into the larger end of tail nozzle 26 from which the exhaust induced into the jet stream along with water and/or air flowing through space 27.

In order to prevent possible entrance of water into exhaust conduit 41 when the jet stream is reversed by vane 30, a normally open check valve in the form of pivotal flap 42 is provided in conduit 41 and a relief valve 43 allows the escape of exhaust from conduit 41 when the pressure rises therein above check valve 42.

A suitable grill 44 protects the mouth of inlet 9, and sleeve 21 protects shaft 6 from entanglement with weeds and the like, should they enter through the grill.

The construction described above provides a jet drive that has all of the advantages of simplicity of assembly and installation, with balanced forces on the butterfly trim and steering vanes, with appropriate fixed bearing support for the drive shaft at both ends, and with engine exhaust into the jet stream.

By reason of the construction, it is possible to mount the shaft 6 to extend upwardly rearwardly at a slight angle of about 7° from the general plane of the bottom of the boat so that planing of the boat is facilitated and there is less drag at planing speeds.

The construction provides two jet nozzles in tandem with their housings concentric and spaced radially to provide for the reverse flow therebetween, and with the trim vane in the second nozzle to effect a closing of the same for establishing the reverse flow.

The thrust of the reverse flow is generally parallel to the drive shaft 6 and gives only a slight lift force so that, if desired, the reverse flow can be effected to slow down forward movement of the boat without danger of driving the bow into the water.

Various modes of carrying out the invention are contemplated within the scope of the following claims particularly pointing out and distinctly claiming the subject matter which is regarded as the invention.

I claim:

1. A water jet drive for a boat, adapted to be secured to the back of the boat transom to be driven by an inboard powered shaft extending through a sealed opening in the transom near the bottom of the boat and comprising when installed on a boat, a tubular housing fixedly secured to the boat transom and having an open water pickup inlet at its forward end facing downwardly at the general level of the bottom of the boat and to the rear of the transom, said housing extending rearwardly and upwardly from said inlet and having an impeller chamber terminating in a jet nozzle generally above the plane of the bottom of the boat and disposed axially at a slight angle rearwardly and upwardly of said plane whereby the water flows in a substantially straight path upwardly and rearwardly from said inlet to and through said nozzle, a substantially non-flexible drive shaft extending through the boat transom and into said impeller chamber axially of said jet nozzle, and an impeller carried by said shaft in said impeller chamber.

2. The drive of claim 1 and a thurst bearing supporting the forward end of said drive shaft in the region of said boat transom, a frictionless bearing supporting the rear end of said drive shaft in said impeller chamber, and diffuser vanes supporting said last named bearing in said jet nozzle.

3. The drive of claim 1 in which said inlet is disposed at an angle of approximately 7° downwardly from the plane of the boat bottom.

4. The drive of claim 1 in which said jet nozzle and shaft are disposed at an angle of approximately 7° upwardly from the plane of the boat bottom.

5. The drive of claim 1 in which said inlet is disposed at an angle of approximately 7° downwardly and rearwardly from the plane of the boat bottom, and said jet nozzle and shaft are disposed at an angle of approximately 7° rearwardly and upwardly from the plane of the boat bottom.

6. A water jet drive for a boat, adapted to be secured to the back of the boat transom to be driven by an inboard powered shaft extending through a sealed opening in the transom near the bottom of the boat and comprising when installed on a boat, a tubular housing rigidly secured to the boat transom and having an open water pickup inlet at its forward end facing downwardly at the general level of the bottom of the boat and to the rear of the transom, said housing extending rearwardly and upwardly from said inlet and having an impeller chamber terminating in a jet nozzle generally above the plane of the bottom of the boat and disposed axially at a slight angle rearwardly and upwardly of said plane, a drive shaft extending through the boat transom and into said impeller chamber axially of said jet nozzle, an impeller carried by said shaft in said impeller chamber, an auxiliary jet nozzle disposed rearwardly in tandem to said first named jet nozzle and generally axially aligned therewith with the skirt of said auxiliary jet nozzle extending forwardly over and generally concentrically spaced from said first named jet nozzle and rigidly secured thereto, and means to close said auxiliary jet nozzle to force the water discharged from said first named jet nozzle to reverse its course and to be discharged forwardly through said space between said nozzles.

7. The drive of claim 6 in which said means comprises a vane mounted in a circular portion of said auxiliary jet nozzle and pivotally adjustable upon a horizontal axis to provide for trim adjustment of the boat.

8. The drive of claim 7 and an internal combustion engine disposed inboard of the boat and connected to drive said drive shaft, an exhaust conduit for said engine leading to the space between said jet nozzles, a check valve in said conduit to prevent water rising therein, and a relief valve for escape of exhaust from said conduit when said check valve is closed.

9. The drive of claim 7 and a steering vane pivotally operable upon a vertical axis rearwardly of said auxiliary jet nozzle, and an auxiliary steering rudder extending downwardly into the surrounding water beneath said steering vane and operable therewith, said rudder additionally serving to steer the boat upon reversal in direction thereof.

10. The drive of claim 6 and an internal combustion engine disposed inboard of the boat and connected to drive said drive shaft, an exhaust conduit for said engine leading to the space between said jet nozzles, a check valve in said conduit to prevent water rising therein, and a relief valve for escape of exhaust from said conduit when said check valve is closed.

11. The drive of claim 6 and a steering vane pivotally operable upon a vertical axis rearwardly of said auxiliary jet nozzle, and an auxiliary steering rudder extending downwardly into the surrounding water beneath said steering vane and operable therewith, said rudder additionally serving to steer the boat upon reversal in direction thereof.

* * * * *